US005321889A

United States Patent [19]

Watanabe

[11] Patent Number: 5,321,889

[45] Date of Patent: Jun. 21, 1994

[54] BASE DRUM OF ELECTROPHOTOGRAPHIC PHOTOCONDUCTOR AND METHOD FOR THE PREPARATION THEREOF

[75] Inventor: Tadashi Watanabe, Numazu, Japan

[73] Assignee: Ricoh Company, Ltd., Tokyo, Japan

[21] Appl. No.: 988,818

[22] Filed: Dec. 10, 1992

Related U.S. Application Data

[62] Division of Ser. No. 792,923, Nov. 15, 1991, abandoned.

[30] Foreign Application Priority Data

| | | | |
|---|---|---|---|
| Nov. 16, 1990 | [JP] | Japan | 2-310960 |
| Nov. 22, 1990 | [JP] | Japan | 2-320141 |
| Jan. 17, 1991 | [JP] | Japan | 3-17176 |
| Mar. 13, 1991 | [JP] | Japan | 3-74146 |
| Aug. 27, 1991 | [JP] | Japan | 3-240649 |

[51] Int. Cl.[5] ..... B21D 39/02

[52] U.S. Cl. ..... 29/895.3; 29/895.33; 72/52

[58] Field of Search ..... 492/37, 54; 29/895.3, 29/895.33; 72/52, 283, 368; 430/58, 127, 128, 60, 68, 69, 126

[56] References Cited

U.S. PATENT DOCUMENTS

| | | | |
|---|---|---|---|
| 3,858,785 | 1/1975 | McLain | 72/52 X |
| 4,480,457 | 11/1984 | Möltner | 72/368 X |
| 4,577,481 | 3/1986 | Staat | 72/368 X |
| 4,593,550 | 6/1986 | Byrd | 72/52 X |
| 4,660,754 | 4/1987 | Byrd | 72/368 X |
| 4,745,787 | 5/1988 | Sansome et al. | 72/283 X |
| 4,754,908 | 7/1988 | Tanaka et al. | 72/368 X |
| 4,796,797 | 1/1989 | Nakako et al. | 72/52 X |
| 4,805,435 | 2/1989 | Sukimoto et al. | 72/283 |
| 4,987,046 | 1/1991 | Kutami et al. | 430/127 |
| 5,076,084 | 12/1991 | Furugen | 72/283 X |

FOREIGN PATENT DOCUMENTS

| | | | |
|---|---|---|---|
| 0165033 | 7/1988 | Japan | 29/895.3 |
| 2203677 | 10/1988 | United Kingdom | 72/52 |

*Primary Examiner*—Timothy V. Eley

*Attorney, Agent, or Firm*—Oblon, Spivak, McClelland, Maier & Neustadt

[57] ABSTRACT

A base drum of an electrophotographic photoconductor has a straightness of 0.04 mm or less, a roundness of 0.04 mm or less, a wall-thickness non-uniformity of ±0.015 mm or less and a maximum surface roughness (Rmax) in the range from 0.3 to 1.0 μm. This base drum is produced by a method in which a metallic sheet in the form of a drum is welded by a high-frequency welder to form an electroseamed tube, and the electroseamed tube is subjected to the ironing or sinking-ironing process.

20 Claims, 7 Drawing Sheets

FIG. 6(a)
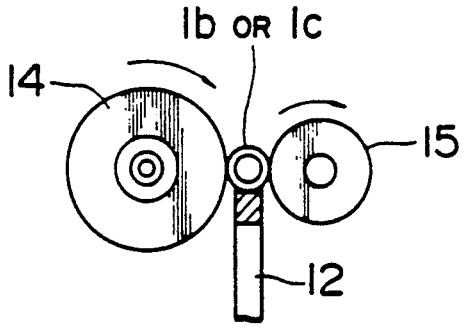
FIG. 6(b)
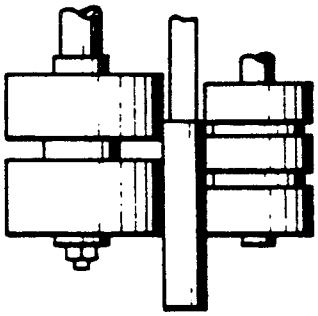
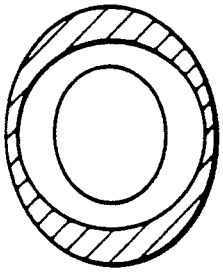
FIG. 7(a)
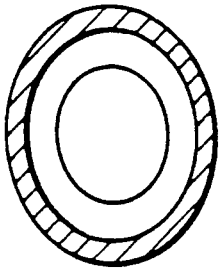
FIG. 7(b)
FIG. 8
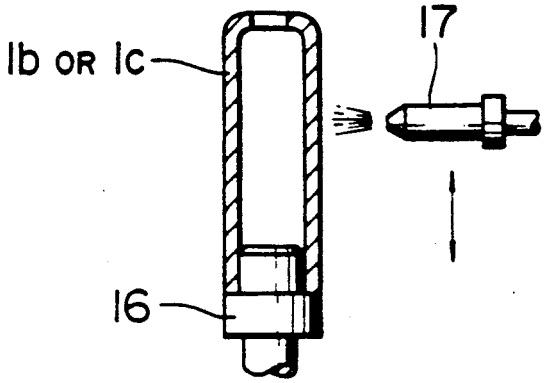

BASE DRUM OF ELECTROPHOTOGRAPHIC PHOTOCONDUCTOR AND METHOD FOR THE PREPARATION THEREOF

This is a division, of application Ser. No. 07/792,923, filed on Nov. 15, 1991 now abandoned.

BACKGROUND OF THE INVENTION

1. Field of the Invention

The present invention relates to a base drum of an electrophotographic photoconductor and a method for preparing the same, and more particularly, a thin-walled base drum with high dimensional accuracy and a desired surface roughness for use in an electrophotographic photo-conductor, and the method for preparing the above base drum from an electroseamed tube.

2. Discussion of Background

Electrophotographic photoconductors which are now practically used are classified into two types from the viewpoint of shape; one is a cylindrical one and the other is a belt-shaped one. They have their own advantages and drawbacks, but the former is more widely utilized because it is adaptable to a large volume of copies and a rapid copying speed.

As shown in FIG. 1, the above-mentioned cylindrical electrophotographic photoconductor is installed in a copying apparatus in such a fashion that a rotating shaft 3 is fitted in the center of a flange 2*a* which is secured to one end of a cylindrical base drum 1 of a photoconductor, and a driving shaft 4 is fitted in the center of a flange 2*b* at the other end of the base drum 1. A photoconductive layer (not shown) is overlaid on the outer surface of the base drum 1.

To prepare this type of base drum 1, conventionally, an aluminum drum (or an aluminum alloy drum) is processed by extrusion and the surface of this aluminum drum is subjected to machining to obtain a mirror surface. This is because the cylindrical base drum of the electrophotographic photoconductor is required to have high dimensional accuracy and uniform surface smoothness.

However, this method of preparing the base drum of this type has the shortcoming that the manufacturing cost is considerably high.

In addition, the material for a photoconductive layer to be coated on the base drum and the thickness of the photoconductive layer are appropriately selected depending on the required photoconductive characteristics. According to the material and the thickness of the photoconductive layer, it is necessary to select the surface profile of the base drum, for example, mirror finish, matte surface or satin surface, and to determine the predetermined surface smoothness (Rmax) thereof, that is, a maximum surface roughness in accordance with JIS B 0601.

For instance, as shown in FIG. 2, the surface roughness of a photoconductive layer 30 varies depending on the thickness of the photoconductive layer even though the surface roughness of the base drum is the same. In the case where the photoconductive layer 30 is thick as shown in FIG. 2(*a*), the surface roughness of the base drum 1' can be compensated by the thickness of the photoconductive layer 30, and the surface roughness of the photoconductive layer can be improved. In FIG. 2(*b*), on the other hand, the photoconductive layer 30 is thin, so that the surface roughness of the base drum 1' have a direct influence on the surface roughness of the photoconductive layer 30. Understandably, therefore, the required surface roughness of the base drum varies depending on the kind of photoconductive layer coated thereon.

Consideration is given to the above-mentioned surface profile and surface roughness of the base drum, the base drum of the electrophotographic photoconductor is conventionally prepared by the following methods. A billet is first made out of aluminum or aluminum alloy ingot, and then a tube is formed by hot-extruding (extruded tube), or a tube is formed by drawing the extruded tube at room temperature (drawn tube). Alternatively, an impact-ironing tube is formed by subjecting the billet to cold-impact extrusion and ironing. In addition, a metallic plate or strip is stamped out and subjected to deep-drawing, thereby forming a tube (deep-drawing tube).

The thus obtained tube is further processed into the base drum of the photoconductor, as disclosed below:

(1) A base drum is prepared by machining both end portions and the outer surface of the extruded or drawn tube. Alternatively, the drawn tube is once annealed and again drawn to prepare a base drum. (Japanese Laid-Open Patent Application 64-4753)

(2) A base drum is prepared by curling an end portion of the extruded tube, machining the outer surface thereof and subjecting the tube to ironing. Alternatively, the impact-ironing tube is used as a base drum after subjecting it to machining or without machining. (Japanese Laid-Open Patent Application 59-90877)

(3) A base drum is prepared by machining the deep-drawing tube. (Japanese Laid-Open Patent Application 59-107357)

(4) A base drum is prepared by improving the straightness of an electroseamed tube or worked electroseamed tube by use of correcting rollers, and/or treating the surface of the electroseamed tube by machining finishing, grinding finishing or abrasion finishing, and/or treating the surface thereof by electropolishing or anodizing. (Japanese Laid-Open Patent Application 63-61376)

As previously mentioned, it is necessary to cause the base drum of the photoconductor to smoothly rotate, centering around the driving shaft secured to the flange, as shown in FIG. 1. Therefore, a demand for high accuracy in the coaxiality, the roundness and the straightness of the outer circumference of the base drum, on the basis of the inner circumference thereof, is increasing, and the surface roughness of the outer surface of the base drum, on which the photoconductive layer is formed, is required to be precise.

However, the conventional base drums produced by the above-mentioned methods cannot satisfy such demands for dimensional accuracy. When the base drum is manufactured by extrusion or drawing, the wall-thickness non-uniformity is $\pm 10$ to $\pm 15\%$ on average on the same circumference of the base drum, and the coaxiality on the basis of the inner circumference and the outer circumference of the base drum is unsatisfactory. In addition, the base drum made by the impact-ironing method has the shortcomings that there is non-uniformity in the wall thickness not only on the same circumference of the base drum, but also in the lengthwise direction of the drum and a bent is observed in the lengthwise direction.

In general, the inner surface and the outer surface of the tube for the base drum is subjected to machining to obtain a desired dimensional accuracy and surface roughness. In the case of preparing a thin-walled tube with a large diameter, the distortion of the tube is caused due to chucking in the course of the machining process, and the deformation of the tube is caused after the machining process. Furthermore, the surface of the tube easily shows the waviness and chatters while the tube is machined by a cutting tool. These will lead to the problems of wear-resistance and durability. In particular, it is difficult to obtain a thin-walled base drum having a long length and a large diameter which has high dimensional accuracy and precise surface roughness.

On the other hand, the base drum prepared by deep-drawing does not necessitate the machining process, so that the above-mentioned problems in the extruded or drawn base drum can be solved, and the productivity is high. However, many steps in the sinking process are required to produce a cylindrical base drum with uniform wall-thickness from a metallic sheet. In addition, it is difficult to prepare a base drum with a long length and a small diameter by this method.

When the base drum is prepared by surface-treating the electroseamed tube or worked electroseamed tube by use of correcting rollers, the dimensional accuracy and the surface roughness of the obtained base drum are not satisfactory.

Furthermore, when there is a demand that the base drum have a surface profile except the mirror surface, such as matte surface or satin surface, the above-mentioned electroseamed tubes are subjected to honing, electropolishing or anodizing after correcting process. However, it is impossible to obtain electroseamed tubes which have a desired surface profile uniformly thereon. In addition, to obtain a predetermined surface roughness (Rmax) of the base drum by machining, it is necessary to change the machining conditions, for example, the machining speed and the feed rate, depending on the desired surface roughness, so that the man-hour of a machining process cannot be made constant.

SUMMARY OF THE INVENTION

Accordingly, a first object of the present invention is to provide a base drum of an electrophotographic photo-conductor with high dimensional accuracy and a uniform surface roughness (Rmax) in the range from 0.3 to 1.0 μm, with the defects on the surface of a tube, such as flaws, scratches and dents being eliminated.

A second object of the present invention is to provide a method for producing the aforementioned base drum of an electrophotographic photoconductor, free from the above-mentioned conventional shortcomings, by which method a variety of base drums, for example, thin-walled base drums with a small diameter and a large diameter, in addition, with a long length can be produced, with high dimensional accuracy, from a tube whose wall-thickness non-uniformity is minimized not only on the same circumference, but also in the lengthwise direction of the tube, without the machining process of the inner and outer surfaces of the tube.

A third object of the present invention is to provide a method for producing the base drum, by which method base drums with high durability can be continuously mass-produced, with the dispersion in product quality minimized and the steps in the preparation method economized.

A fourth object of the present invention is to provide a method for producing the base drum, by which method base drums with different surface profile and surface roughness can be produced in accordance with the kind of photoconductive material which is coated or deposited on the base drum.

The above-mentioned first object of the present invention can be achieved by a base drum of an electrophotographic photoconductor having a straightness of 0.04 mm or less, a roundness of 0.04 mm or less, a wall-thickness non-uniformity of ±0.015 mm or less and a maximum surface roughness (Rmax) in the range from 0.3 to 1.0 μm.

The second to fourth objects of the present invention can be achieved by a method for producing the base drum of an electrophotographic photoconductor, comprising the sequential steps of:

forming a metallic sheet in the form of a tube having a seam;

welding the seam of the tube by high-frequency welding to form an electroseamed tube;

curling one end of the electroseamed tube;

ironing the electroseamed tube; and cutting both end portions of the electroseamed tube.

The above-mentioned method for producing the base drum may further comprise a step of plug-inserted-drawing the electroseamed tube and improving the straightness of the tube by use of correcting rollers prior to the curling step.

Further, in the above-mentioned method, a step of sinking-ironing may be employed instead of the ironing step subsequent to the curling step.

In addition, a step of treating the surface of the electroseamed tube, such as grinding finishing, abrasion finishing, honing, electropolishing or anodizing can be added subsequent to or prior to the curling step in the preparation method.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 6(*a*) and 6(*b*) are a vertical sectional view and a side view of a centerless grinder, respectively;

FIGS. 7(*a*) and 7(*b*) are vertical sectional views of the base drums which illustrate the presence or absence of wall-thickness non-uniformity;

FIG. 8 illustrates the manufacturing process in which the electroseamed tube is subjected to liquid honing;

DESCRIPTION OF THE PREFERRED EMBODIMENTS

The method for preparing the base drum of an electrophotographic photoconductor according to the present invention will now be explained in detail by referring to the attached figures.

Figure 1:
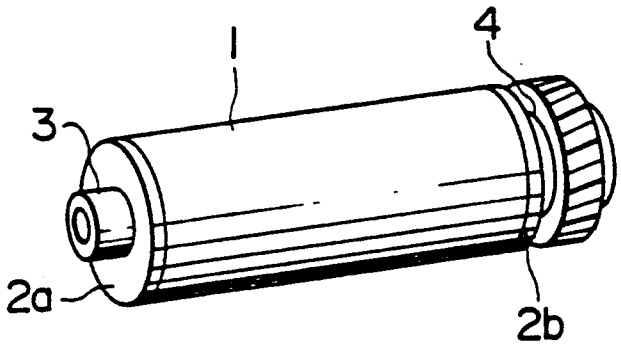
FIG. 1 is a perspective view of a base drum of an electrophotographic photoconductor.
Figure 2A:
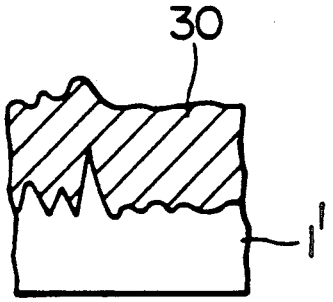
FIGS. 2(*a*) and 2(*b*) are schematic cross-sectional views of electrophotographic photoconductors which illustrate the influence of the surface profile of a base drum on the surface condition of a photoconductive layer depending on the thickness of the photoconductive layer.
Figure 2B:
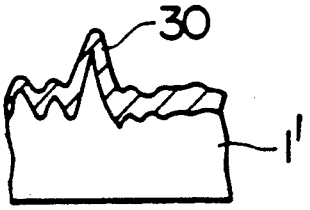

FIG. 1 shows a cylindrical base drum of the electrophotographic photoconductor of the present invention. As previously mentioned, flanges 2*a* and 2*b* are secured to a base drum 1. A rotation shaft 3 is fitted in the center of the flange 2*a*, and a driving shaft 4 is fitted in the center of the flange 2*b* to rotate the base drum 1 smoothly.

The dimensional accuracy and the surface roughness of the base drum 1 of the electrophotographic photoconductor according to the present invention are as follows:

| | |
|---|---|
| Straightness: | 0.04 mm or less, preferable 0.03 mm or less (further preferable 0.02 mm or less) |
| Roundness: | 0.04 mm or less, preferable 0.03 mm or less (further preferably 0.02 mm or less) |
| Wall-thickness non-uniformity: | within ±0.015 mm, preferably within ±0.01 mm (further preferably within ±0.005 mm) |
| Surface roughness (Rmax): | 0.3 to 1.0 μm, preferably 0.3 to 0.5 μm |

When the straightness, the roundness and the surface roughness of the base drum are within the above-mentioned range, the electrophotographic photoconductor comprising this base drum can yield uniform images. When the wall-thickness non-uniformity of the base drum is within the above-mentioned range, the runout of the base drum can be minimized after flanging, and accordingly the images can be obtained uniformly and without any abnormality due to flaws and the joint on the surface of the base drum.

To prepare the base drum of the present invention, an electroseamed tube or a worked electroseamed tube which has been surface-treated is subjected to at least the ironing process, or the sinking-ironing process. This sinking-ironing process is carried out integratedly.

Specific examples of the electroseamed tube material for the base drum include aluminum, copper, stainless steel, nickel, iron and alloys thereof, and steel. Among the above, aluminum and aluminum alloys are preferable for the base drum material of the electrophotographic photoconductor. In particular, pure aluminum #1000, and non-heat-treated alloys such as Al-Mn alloys #3000 and Al-Mg alloys #5000 are most preferable.

Figure 3:
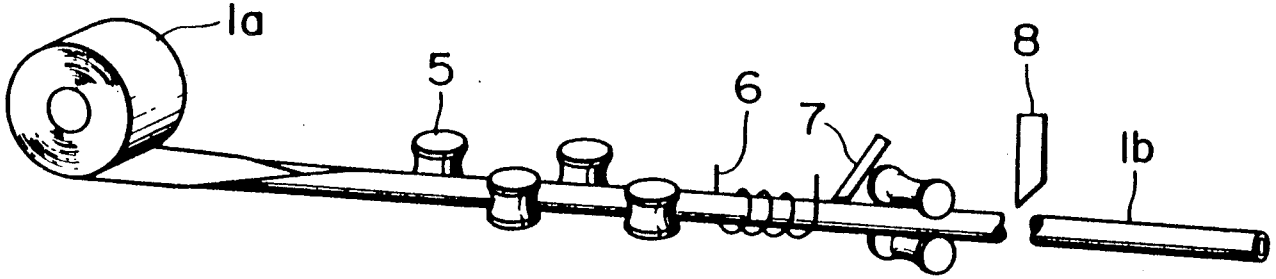
FIG. 3 illustrates the manufacturing process in which a metallic strip is turned into an electroseamed tube.

As shown in FIG. 3, a metallic strip 1*a* is turned into an electroseamed tube 1*b* in such a manner that both edges of the metallic strip 1*a* are butted to form a drum by a plurality of rollers (forming rollers) 5. The joint thereof is then continuously welded by a high-frequency welder 6 at a speed of 1 to 100 m/min. Subsequently, the outer surface and the inside of the welded portion are subjected to machining with a cutting tool 7 to satisfy the predetermined dimensional accuracy and surface profile, and then the tube is cut to a predetermined length by a cutter 8 to form an electroseamed tube 1*b*.

A metallic plate can also be turned into an electroseamed tube by the same process as shown in FIG. 3.

Figure 4A:
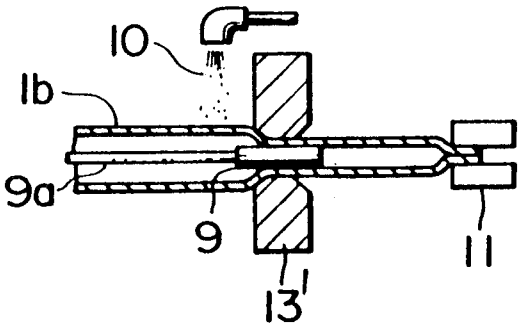
FIGS. 4(*a*)–4(*c*) illustrates the manufacturing process in which the electroseamed tube is subjected to plug-inserted drawing process, and surface-treated by use of correcting rollers to improve the dimensional accuracy.
Figure 4:
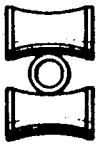
Figure 4:
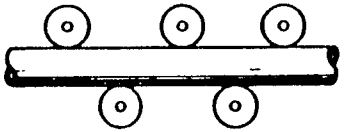
Figure 4C:
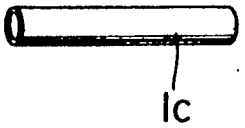

The electroseamed tube 1*b* prepared in the steps as shown in FIG. 3, which may not be always cut to a predetermined length, is subjected to a drawing process in such a fashion that a plug with an outer diameter smaller than the inner diameter of the electroseamed tube is inserted into the electroseamed tube and the tube is drawn through a die having a slot with a diameter smaller than the outer diameter of the electroseamed tube, as in FIG. 4(*a*), and subjected to a correcting process in FIGS. 4($b_1$) and 4($b_2$) for the purpose of sizing and improving the dimensional accuracy. The above-mentioned drawing process is hereinafter referred to as "plug-inserted drawing". In FIG. 4(*a*), a lubricant 10 is applied to the electroseamed tube 1*b*, and the electroseamed tube 1*b* in which a plug 9 supported by a rod 9*a* is inserted is drawn through a drawing die 13' by tongs 11. In FIGS. 4($b_1$) and 4($b_2$), the electroseamed tube 1*b* is finished by correcting rollers in order to increase the straightness thereof. The electroseamed tube thus subjected to the plug-inserted drawing process is hereinafter referred to as drawn electroseamed tube 1*c* (in FIG. 4(*c*)).

Figures 5, 5A, 5D:
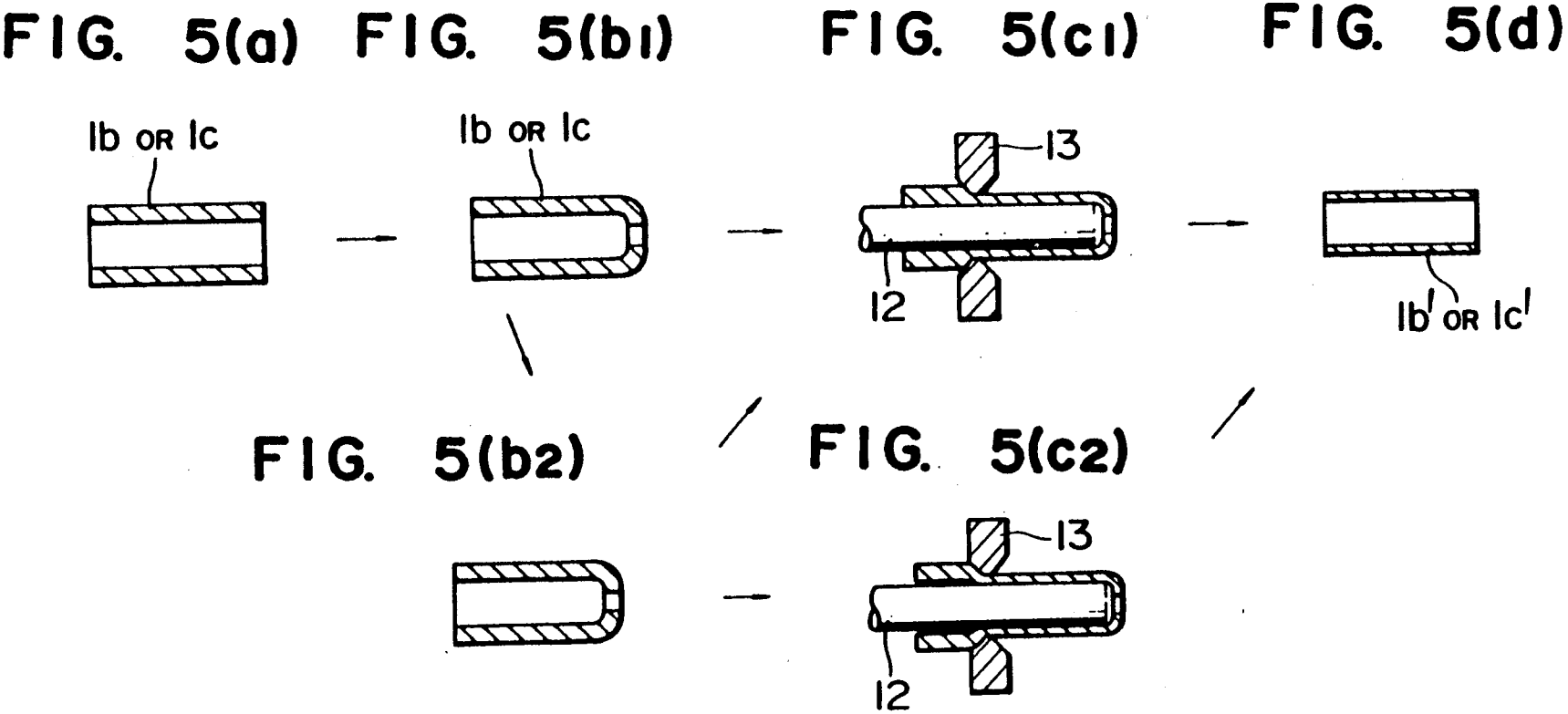
FIGS. 5(*a*)–5(*c*) illustrates the manufacturing process in which the electroseamed tube is subjected to curling and ironing (or sinking-ironing)
Figure 9A:
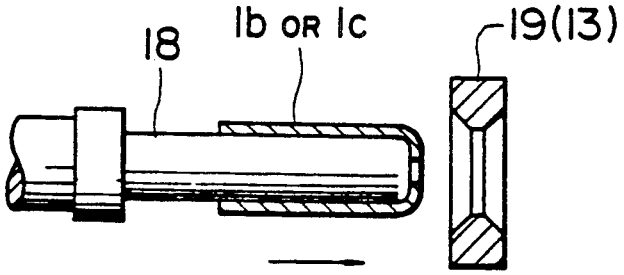
FIGS. 9(*a*) to 9(*d*) illustrate the manufacturing process in which the electroseamed tube is subjected to ironing.
Figure 9B:
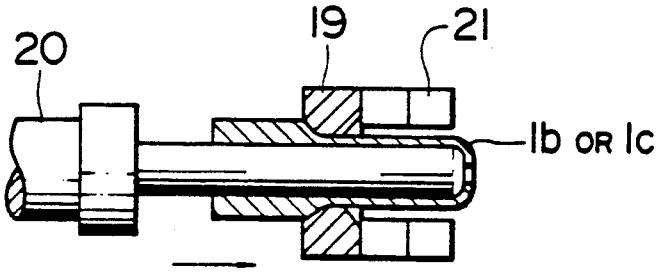
Figure 9C:
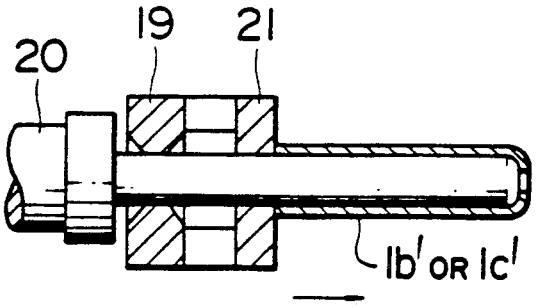
Figure 9D:
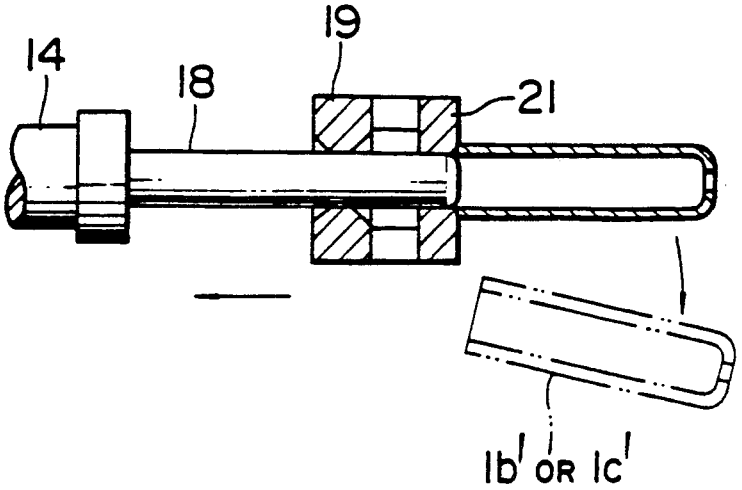

In FIG. 5, one end portion of the electroseamed tube 1*b* or the drawn electroseamed tube 1*c* is first curled (FIG. 5($b_1$)) so as to withstand the subsequent ironing process. Then, the electroseamed tube 1*b* or the drawn electroseamed tube 1*c* is subjected to the ironing process (FIG. 5($c_1$)) or the sinking and ironing process (FIG. 5($c_2$)). Both ends of the thus obtained electroseamed tube 1*b* or 1*c* are cut so that it can be used as the base drum of the electrophotographic photoconductor, and the base drum 1*b*' or 1*c*' as shown in FIG. 5(*d*) can be prepared.

Furthermore, prior to or subsequent to the above-mentioned curing process, it is preferable that the electroseamed tube 1*b* or the drawn electroseamed tube 1*c* be subjected to surface-treatment such as grinding or abrasion finishing, electropolishing, anodizing or honing (FIG. 5($b_2$)) to prepare for the ironing process.

The grinding or abrasion finishing is conducted by use of a centerless grinder as shown in FIG. 6.

The electroseamed tube 1*b* or the drawn electroseamed tube 1*c* is fed into the grinding position on a blade 12 and caused to pass through the space between a grinding wheel 14 and a regulating wheel 15 which are disposed at proper intervals. Thus, the electroseamed tube 1*b* or the drawn electroseamed tube 1*c* is finished by grinding or abrasion finishing to have a predetermined dimensional accuracy and surface roughness. In the grinder shown in FIG. 6, an elastic material is fixed on the blade 12 and the upper surface of the elastic material is surface-treated to be smooth so as not to impair the electroseamed tube 1*b* or drawn electroseamed tube 1*c*. For example, hide, oil-resistant synthetic rubber and synthetic resin can be used as such an elastic material.

The grinding lubricant for use in the grinder varies depending on the kind of grinding wheel 14, and water-soluble grinding oil or illuminating kerosine is generally employed. In the case where the illuminating kerosine is used as the grinding oil, a slippage occurs between the electroseamed tube 1*b* or 1*c* and the regulating wheel 15 to provide a feed thereto, thereby disturbing the feeding function. To solve this problem, it is preferable that an oil-resistant synthetic rubber with a high friction coefficient be used as the material for the regulating wheel 15 and grooves be cut on the periphery of the regulating wheel 15 to reduce the contact area between the electroseamed tube 1*b* or 1*c* and the regulating wheel 15 as shown in FIG. 6(*b*).

An elastic and flexible material, for example, commercially available PVA (polyvinyl alcohol) grinding wheel and buff flap, made by Nippon Tokushu Kento Co., Ltd., are preferably employed for the grinding wheel 14. It is desirable that the grit of the grinding wheel 14 be appropriately selected in a wide range.

The electroseamed tube is superior in the wall-thickness non-uniformity, but slightly inferior in the roundness of the outer circumference. When the outer surface of this electroseamed tube is subjected to grinding or abrasion finishing by use of a hard grinding wheel such as green silicon carbide grinding wheel or white fused alumina grinding wheel, high spots on the outer surface of are ground. In this case, the roundness of the outer circumference can be improved, but the wall-thickness non-uniformity is caused because the inner surface of the tube is not machined, as shown in FIG. 7(*a*).

When this electroseamed tube of which wall-thickness is non-uniform is subjected to the subsequent ironing process, the amount of the wall material which is to be ironed is different in a cross section of the tube. As a result, the ironed degree of the wall material is diverse at a thin-walled portion and at a thick-walled portion, so that a base drum with highly accurate straightness and roundness cannot be obtained.

Therefore, it is necessary to subject the electroseamed tube to grinding or abrasion finishing for improving the roundness of the outer circumference, without causing the wall-thickness non-uniformity, as shown in FIG. 7(*b*). The object of the grinding or abrasion finishing in the present invention is to grind or abrade the outer surface of the electroseamed tube as uniformly as possible by using an elastic grinding wheel having high flexibility in order to improve the roundness of the outer circumference and to obtain the desired surface roughness by eliminating the flaws, without causing the wall-thickness non-uniformity.

Furthermore, to obtain the base drum having a desired surface profile, the surface-treatment such as honing, electropolishing or anodizing can be conducted instead of the above-mentioned grinding or abrasion finishing prior to the ironing process.

In FIG. 8, the electroseamed tube is subjected to liquid honing by use of a liquid honing machine. The electroseamed tube 1*b* or the drawn electroseamed tube 1*c* is placed on a rotational chuck 16 and smoothly driven in rotation. The outer surface of the electroseamed tube 1*b* or 1*c* is blasted with a mixture of an abrasive material and water which is sprayed from a nozzle 17 of a spray gun by use of compressed air. By rotating the rotational chuck 16 synchronously with the vertical feed of the nozzle 17 of the spray gun, the outer surface of the electroseamed tube 1*b* or 1*c* can be finished to have uniform surface roughness.

According to the kind and the grit of abrasive material and the blasting conditions, a desired surface profile and surface roughness can be obtained. As the abrasive material for use in the present invention, hard aluminum oxide whose particles have a sharp angle, relatively soft silica particles which is cheap, and spherical glass beads can be used. The grit of the abrasive material can be selected in the range from #60 to #1,000 in accordance with the purpose.

The electroseamed tube thus surface-treated by grinding or abrasion finishing, honing, electropolishing or anodizing is finally subjected to the ironing process.

FIG. 9 illustrates the procedure of the ironing process in detail. In FIG. 9(*a*), a punch 18 and a die 19 are disposed coaxially along the passage of the punch 18. The electroseamed tube 1*b* or drawn electroseamed tube 1*c* which has been subjected to the curling process, as shown in FIG. 5($b_1$), is fitted on the end portion of the punch 18 so as to withstand the pressure applied to the electroseamed tube in the ironing process. The surface of the die 19, in contact with the electroseamed tube 1*b* or 1*c*, is designed so that the high accuracy can be maintained in order to impart the desired surface roughness and roundness to the electroseamed tube 1*b* or 1*c*. It is desirable that the roundness of the die 19 be about 3 μm or less and the surface roughness (Rmax) thereof be about 0.1 μm or less.

In FIG. 9(*a*), the electroseamed tube 1*b* or 1*c* of which one end portion is curled in the previously mentioned curling step is fitted on the punch 18, and fed to the die 19 in the direction of the arrow. In FIG. 9(*b*), the electroseamed tube 1*b* or 1*c* is subjected to sinking and ironing at the same time. Reference numeral 20 indicates a hydraulic press ram, and reference numeral 21, a stripper.

After the completion of the ironing process, the stripper 21 is shifted in FIG. 9(*c*), and the electroseamed tube 1*b* or 1*c* is released from the punch 18 in FIG. 9(*d*). At this time, the open end portion of the electroseamed tube 1*b* or 1*c* is pressed, so that the deformation is caused on the tube 1*b* or 1*c*. Such deformation, however, has no effect on the dimensional accuracy of the obtained base drum because the electroseamed tube is cut approximately 10 mm distant from the open end portion thereof subsequent to the sinking and ironing process.

The electroseamed tube 1*b* or 1*c* thus subjected to the ironing process is made into a thin-walled base drum of the electrophotographic photoconductor with high dimensional accuracy. In other words, it is necessary to conduct the ironing process under properly adjusted conditions to obtain the thin-walled base drum with high dimensional accuracy.

In the ironing process, depending on the kind of electroseamed tube, that is, the electroseamed tube 1*b* or the drawn electroseamed tube 1*c*, the ironing method (FIG. 5($c_1$)) or the sinking-ironing method (FIG. 5($c_1$)) may be selected, with the number of ironing steps taken into consideration. In general, the sinking-ironing method is applied to the electroseamed tube 1*b*, and the ironing method is applied to the drawn electroseamed tube 1*c*. This selection is important from the viewpoint of improvement in the dimensional accuracy of the obtained base drum and of economization of the manufacturing steps. Both the ironing method and the sinking-ironing method ma be conducted in combination.

Figure 10A:
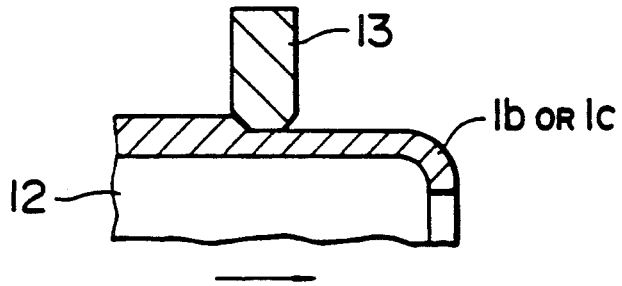
FIGS. 10(*a*) and 10(*b*) illustrates the one-step ironing process and the two-step ironing process.
Figure 10B:
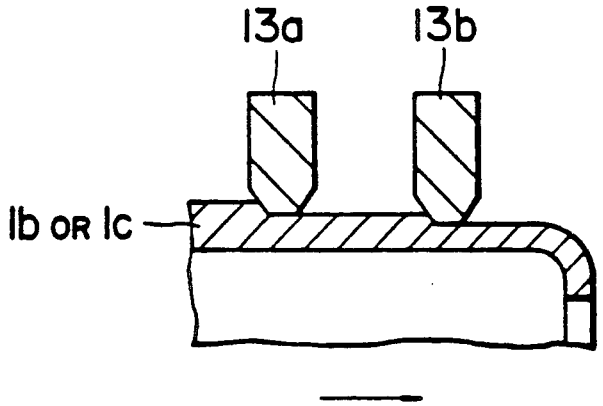

FIGS. 10(*a*) and 10(*b*) illustrate the number of ironing steps in the ironing (or sinking-ironing) method. In FIG. 10(*a*), the electroseamed tube 1*b* or 1*c* is subjected to the one-step ironing by using a die 13. In FIG. 10(*b*), the electroseamed tube 1*b* or 1*c* is subjected to the two-step ironing by using dies 13*a* and 13*b*. The number of the ironing steps may be three or more, but the less the number of the ironing steps, the more desirable. In addition, it is desirable that the ironing efficiency be as high as possible at each ironing step, with the kind of electroseamed tube and/or the limitation of ironing imposed on the electroseamed tube taken into consideration. Thus, when the appropriate number of ironing steps is determined, the wall-thickness non-uniformity of the electroseamed tube can be minimized.

The thus obtained base drum of the electrophotographic photoconductor is cleaned with water or an organic solvent, and an inorganic or organic photoconductive layer is formed thereon by the conventional method. When necessary, an intermediate layer may be interposed between the base drum and the photoconductive layer or a protective layer may be overlaid on the photoconductive layer.

Other features of this invention will become apparent in the course of the following description of exemplary embodiments, which are given for illustration of the invention and are not intended to be limiting thereof.

EXAMPLE 1

An Al-Mg alloy (5052H-24) in the form of a drum was continuously welded by a high-frequency welder 6 via a plurality of rollers 5, as shown in FIG. 3. The welded portion was machined by a cutting tool 7 and cut by a cutter 8, so that an Al-Mg alloy electroseamed tube 1*b* was prepared.

The thus prepared electroseamed tube 1*b* was subjected to plug-inserted drawing as shown in FIG. 4, so that the drawn electroseamed tube 1*c* having an outer diameter of 40.0 mm, a thickness of 1.0 mm and a length of 300 mm was obtained.

One end portion of the above-prepared drawn electroseamed tube 1*c* was curled, as shown in FIG. 5($b_1$).

The electroseamed tube 1*c* was subjected to the one-step ironing process at the ironing efficiency of 37.5%, using a commercially available polybutene "HV-15" (Trademark), made by Nippon Oil Co., Ltd., as a lubricant, in such a manner that the electroseamed tube 1*c* was fitted on a punch 18 (SKD-11, with a quenching hardness of Rockwell C 53 to 55) and pressed through a die 19 (sintered hard alloy, with a quenching hardness of Rockwell A 85 to 90, and surface roughness Rmax of 0.1 μm or less) while driven by a hydraulic press 20 (commercially available cross-feed 20-t hydraulic press, made by Amino Seisakusho Co., Ltd.), as shown in FIG. 9.

Thus, a base drum of an electrophotographic photoconductor according to the present invention was obtained.

The surface roughness (Rmax) of the obtained base drum was approximately 0.6 μm. The dimensional accuracy of the obtained base drum is as follows:

TABLE 1

| Measurement Item | Drawn Electroseamed Tube (Before Ironing) | | | Base Drum after Ironing Process | | |
|---|---|---|---|---|---|---|
| | Max | Min | R(*) | Max | Min | R(*) |
| Dimensional Accuracy (mm) | | | | | | |
| Straightness(**) | 0.033 | — | — | 0.015 | — | — |
| Roundness(***) | 0.028 | — | — | 0.010 | — | — |
| Wall-Thickness (mm)(****) | | | | | | |
| (A) | 1.599 | 1.575 | 0.024 | 1.009 | 0.994 | 0.015 |

TABLE 1-continued

| Measurement Item | Drawn Electroseamed Tube (Before Ironing) | | | Base Drum after Ironing Process | | |
|---|---|---|---|---|---|---|
| | Max | Min | R(*) | Max | Min | R(*) |
| (B) | 1.599 | 1.596 | 0.003 | 1.002 | 0.997 | 0.005 |

In the above table, (*)R = Max − Min (**)The "straightness" for measuring the dimensional accuracy in the above table is the maximum straightness obtained by measuring the straightness at 40 points on the outer peripheral surface of the electroseamed tube (or base drum) with the opposite ends cut.

These 40 points were the points of intersection of (1) the four generating lines extending in the axial direction of the tube along the peripheral surface of the tube, passing through the four points at which the circumference of the tube is equally divided into four, and (2) 10 circumferential lines positioned at equal intervals along the length of the tube with their circumferential planes at right angles to the axis of the tube, that is, 40 (= 4 × 10) in total.

(***)The "roundness" of the electroseamed tube (or base drum) for measuring the dimensional accuracy in the above table is the maximum roundness obtained by measuring at the 10 circumferential lines positioned at equal intervals extending in the axial longitudinal direction of the tube.

(****)The wall-thickness for measuring the dimensional accuracy in the above table was measured at 12 points on the outer peripheral surface of the electroseamed tube (or base drum). These 12 points were the points of intersection of (1) the four generating lines extending in the axial direction of the tube along the peripheral surface of the tube, passing through the four points at which the circumference of the tube is equally divided into four, and (2) 3 circumferential lines positioned at equal intervals along the length of the tube with their circumferential planes at right angles to the axis of the tube, that is, 12 (= 4 × 3) in total.

() The "straightness" for measuring the dimensional accuracy in the above table is the maximum straightness obtained by measuring the straightness at 40 points on the outer peripheral surface of the electroseamed tube (or base drum) with the opposite ends cut. These 40 points were the points of intersection of (1) the four generating lines extending int he axial direction of the tube along the peripheral surface of the tube, passing through the four points at which the circumference of the tube is equally divided into four, and (2) 10 circumferential lines positioned at equal intervals along the length of the tube with their circumferential planes at right angles to the axis of the tube, that is, 40 (=4×10) in total. (*) The "roundness" of the electroseamed tube (or base drum) for measuring the dimensional accuracy in the above table is the maximum roundness obtained by measuring at the 10 circumferential lines positioned at equal intervals extending in the axial longitudinal direction of the tube. (****) The wall-thickness for measuring the dimensional accuracy in the above table was measured at 12 points on the outer peripheral surface of the electroseamed tube (or base drum). These 12 points were the points of intersection of (1) the four generating lines extending in the axial direction of the tube along the peripheral surface of the tube, passing through the four points at which the circumference of the tube is equally divided into four, and (2) 3 circumferential lines positioned at equal intervals along the length of the tube with their circumferential planes at right angles to the axis of the tube, that is, 12 (=4×3) in total.

Then, the thickness of the wall is measured at the above-determined 12 measuring points by using a commercially available ultrasonic thicknessmeter "CL304" (Trademark), made by K. Branson Co., Ltd.

(A): the maximum wall thickness and the minimum wall thickness at which the difference between the maximum wall thickness and the minimum wall thickness on the same circumference is maximum.

(B): the maximum wall thickness and the minimum wall thickness at which the difference between the maximum wall thickness and the minimum wall thickness on the same generating line extending in the axial direction of the tube is maximum.

EXAMPLE 2

An Al-Mn alloy (3004H-32) in the form of a drum was continuously welded by a high-frequency welder 6 via a plurality of rollers 5, as shown in FIG. 3. The welded portion was machined by a cutting tool 7 and cut by a cutter 8, so that an Al-Mn alloy electroseamed tube 1*b* having an outer diameter of 40.0 mm, a thickness of 1.0 mm and a length of 300 mm was prepared.

One end portion of the above-prepared electroseamed tube 1*b* was curled, as shown in FIG. 5($b_1$).

Under the same conditions as in Example 1, the electroseamed tube 1*b* was subjected to the two-step sinking-ironing process at the ironing efficiency of 44.4%.

Thus, a base drum of an electrophotographic photoconductor according to the present invention was obtained.

The surface roughness (Rmax) of the obtained base drum was approximately 0.9 μm. The dimensional accuracy of the obtained base drum, measured by the same methods as in Example 1, is as follows:

TABLE 2

| Measurement Item | Electroseamed Tube (Before Ironing) | | | Base Drum after Ironing Process | | |
|---|---|---|---|---|---|---|
| | Max | Min | R | Max | Min | R |
| Dimensional Accuracy (mm) | | | | | | |
| Straightness | 0.210 | — | — | 0.022 | — | — |
| Roundness | 0.355 | — | — | 0.028 | — | — |
| Wall-Thickness (mm) | | | | | | |
| (A) | 1.865 | 1.830 | 0.035 | 1.017 | 1.003 | 0.014 |
| (B) | 1.865 | 1.857 | 0.008 | 1.009 | 1.003 | 0.006 |

EXAMPLE 3

An Al-Mn alloy (3004H-34) in the form of a drum was continuously welded by a high-frequency welder 6 via a plurality of rollers 5, as shown in FIG. 3. The welded portion was machined by a cutting tool 7 and cut by a cutter 8, so that an Al-Mn alloy electroseamed tube 1*b* having an outer diameter of 40.0 mm, a thickness of 1.0 mm and a length of 300 mm was prepared.

One end portion of the above-prepared electroseamed tube 1*b* was curled, as shown in FIG. 5($b_1$).

Under the same conditions as in Example 1, the electroseamed tube 1*b* was subjected to the two-step ironing process at the ironing efficiency of 50%.

Thus, a base drum of an electrophotographic photoconductor according to the present invention was obtained.

The surface roughness (Rmax) of the obtained base drum was approximately 0.9 μm. The dimensional accuracy of the obtained base drum, measured by the same methods as in Example 1, is as follows:

TABLE 3

| Measurement Item | Electroseamed Tube (Before Ironing) | | | Base Drum after Ironing Process | | |
|---|---|---|---|---|---|---|
| | Max | Min | R | Max | Min | R |
| Dimensional Accuracy (mm) | | | | | | |
| Straightness | 0.092 | — | — | 0.030 | — | — |
| Roundness | 0.105 | — | — | 0.025 | — | — |
| Wall-Thickness (mm) | | | | | | |
| (A) | 2.039 | 1.996 | 0.043 | 1.012 | 1.007 | 0.005 |

TABLE 3-continued

| Measurement Item | Electroseamed Tube (Before Ironing) | | | Base Drum after Ironing Process | | |
|---|---|---|---|---|---|---|
| | Max | Min | R | Max | Min | R |
| (B) | 2.039 | 2.029 | 0.010 | 1.011 | 1.007 | 0.004 |

EXAMPLE 4

An Al-Mn alloy (3004H-32) in the form of a drum was continuously welded by a high-frequency welder 6 via a plurality of rollers 5, as shown in FIG. 3. The welded portion was machined by a cutting tool 7 and cut by a cutter 8, so that an Al-Mn alloy electroseamed tube 1*b* having an outer diameter of 39.6 mm, a thickness of 0.85 mm and a length of 300 mm was prepared.

One end portion of the above-prepared electroseamed tube 1*b* was curled, as shown in FIG. 5($b_1$).

Under the same conditions as in Example 1, the electroseamed tube 1*b* was subjected to the two-step sinking-ironing process at the ironing efficiency of 52.8%.

Thus, a base drum of an electrophotographic photoconductor according to the present invention was obtained.

The surface roughness (Rmax) of the obtained base drum was approximately 0.5 μm. The dimensional accuracy of the obtained base drum, measured by the same methods as in Example 1, is as follows:

TABLE 4

| Measurement Item | Electroseamed Tube (Before Ironing) | | | Base Drum after Ironing Process | | |
|---|---|---|---|---|---|---|
| | Max | Min | R | Max | Min | R |
| Dimensional Accuracy (mm) | | | | | | |
| Straightness | 0.114 | — | — | 0.018 | — | — |
| Roundness | 0.126 | — | — | 0.030 | — | — |
| Wall-Thickness (mm) | | | | | | |
| (A) | 2.032 | 2.004 | 0.028 | 0.874 | 0.859 | 0.015 |
| (B) | 2.036 | 2.029 | 0.007 | 0.865 | 0.859 | 0.006 |

EXAMPLE 5

An Al-Mn alloy (3004H-32) in the form of a drum was continuously welded by a high-frequency welder 6 via a plurality of rollers 5, as shown in FIG. 3. The welded portion was machined by a cutting tool 7 and cut by a cutter 8, so that an Al-Mn alloy electroseamed tube 1*b* having an outer diameter of 42.0 mm, a thickness of 2.0 mm and a length of 158 mm was prepared.

The thus prepared electroseamed tube 1*b* was subjected to grinding or abrasion finishing by using a commercially available centerless grinder, made by K.K. Nomizu Kikai Seisaku-sho, under the conditions that a rotational speed of a grinding wheel was 1360 rpm, and a feed rate was 0.75 m/min. The grinding wheel 14 employed a commercially available 600-grit buff flap, made by Nippon Tokushu Kento Co., Ltd.

One end portion of the above-prepared electroseamed tube 1*b* was curled, as shown in FIG. 5($b_1$).

Under the same conditions as in Example 1, the electroseamed tube 1*b* was subjected to the two-step ironing process at the ironing efficiency of 50.0%.

Thus, a base drum of an electrophotographic photoconductor according to the present invention was obtained.

The surface roughness (Rmax) and the dimensional accuracy of the obtained base drum are shown in Table 5.

EXAMPLE 6

An Al-Mg alloy (5052H-24) in the form of a drum was continuously welded by a high-frequency welder 6 via a plurality of rollers 5, as shown in FIG. 3. The welded portion was machined by a cutting tool 7 and cut by a cutter 8, so that an Al-Mg alloy electroseamed tube 1*b* was prepared.

The thus prepared electroseamed tube 1*b* was subjected to plug-inserted drawing as shown in FIG. 4, so that the drawn electroseamed tube 1*c* having an outer diameter of 41.2 mm, a thickness of 1.6 mm and a length of 203 mm was obtained.

The thus prepared electroseamed tube 1*c* was subjected to grinding or abrasion finishing in the same manner as in Example 5.

One end portion of the above-prepared electroseamed tube 1*c* was curled, as shown in FIG. 5($b_1$).

Under the same conditions as in Example 1, the electroseamed tube 1*c* was subjected to the one-step ironing process at the ironing efficiency of 37.5%.

Thus, a base drum of an electrophotographic photoconductor according to the present invention was obtained.

The surface roughness (Rmax) and the dimensional accuracy of the obtained base drum are shown in Table 5.

EXAMPLE 7

An Al-Mn alloy (3004H-34) in the form of a drum was continuously welded by a high-frequency welder 6 via a plurality of rollers 5, as shown in FIG. 3. The welded portion was machined by a cutting tool 7 and cut by a cutter 8, so that an Al-Mn alloy electroseamed tube 1*b* having an outer diameter of 42.0 mm, a thickness of 1.8 mm and a length of 171 mm was prepared.

The thus prepared electroseamed tube 1*b* was subjected to grinding or abrasion finishing in the same manner as in Example 6 except that the grinding wheel 14 employed a commercially available 600-grit PVA grinding wheel, made by Nippon Tokushu Kento Co., Ltd.

One end portion of the above-prepared electroseamed tube 1*b* was curled, as shown in FIG. 5($b_1$).

Under the same conditions as in Example 1, the electroseamed tube 1*b* was subjected to the two-step sinking-ironing process at the ironing efficiency of 52.8%.

Thus, a base drum of an electrophotographic photoconductor according to the present invention was obtained.

The surface roughness (Rmax) and the dimensional accuracy of the obtained base drum are shown in Table 5.

TABLE 5

| Example No. | 5 | 6 | 7 |
|---|---|---|---|
| Electroseamed Tube or Drawn Electroseamed Tube | | | |
| Surface roughness (Rmax)(*) | 5.32 μm | 3.78 μm | 4.64 μm |
| Surface condition | rolled surface | drawn surface | rolled surface |
| Wall-thickness non-uniformity (mm)(**) | 0.037 (max) | 0.018 (max) | 0.026 (max) |
| After Grinding or Abrasion Finishing | | | |
| Surface roughness (Rmax) | 1.22 μm | 2.20 μm | 1.12 μm |
| Surface condition | abraded surface | abraded surface | ground surface |
| Wall-thickness non-uniformity (mm) | 0.035 (max) | 0.020 (max) | 0.045 (max) |
| After Ironing or After Sinking-Ironing | | | |
| Surface roughness (Rmax) | 0.84 μm | 0.48 μm | 0.30 μm |
| Surface condition | ironed mirror surface | ironed mirror surface | ironed mirror surface |
| Wall-thickness non-uniformity (mm) | 0.025 (max) | 0.010 (max) | 0.025 (max) |
| Straightness (mm)(***) | 0.030 (max) | 0.020 (max) | 0.022 (max) |
| Roundness (mm)(****) | 0.035 (max) | 0.015 (max) | 0.025 (max) |

In the above table:
(*)measured by a commercially available measuring apparatus "Surfcom" (Trademark), made by Tokyo Seimitsu Co., Ltd.
(**)measured by a commercially available ultrasonic thicknessmeter "CL304" (Trademark), made by K. Branson Co., Ltd.
(***)measured by a commercially available laser scan micro meter "Laser Micro" (Trademark), made by Mitsutoyo.
(****)measured by a commercially available laser scan micro meter "Laser Micro"(-Trademark), made by Mitsutoyo.

In the above table: (*) measured by a commercially available measuring apparatus "Surfcom" (Trademark), made by Tokyo Seimitsu Co., Ltd. () measured by a commercially available ultrasonic thicknessmeter "CL304" (Trademark), made by K. Branson Co., Ltd. (*) measured by a commercially available laser scan micro meter "Laser Micro" (Trademark), made by Mitsutoyo. (****) measured by a commercially available laser scan micro meter "Laser Micro" (Trademark), made by Mitsutoyo.

EXAMPLE 8

An Al-Mg alloy (5052H-24) in the form of a drum was continuously welded by a high-frequency welder 6 via a plurality of rollers 5, as shown in FIG. 3. The welded portion was machined by a cutting tool 7 and cut by a cutter 8, so that an Al-Mg alloy electroseamed tube 1*b* was prepared.

The thus prepared electroseamed tube 1*b* was subjected to plug-inserted drawing as shown in FIG. 4, so that the drawn electroseamed tube 1*c* having an outer diameter of 41.2 mm, a thickness of 1.6 mm and a length of 203 mm was obtained.

The thus prepared electroseamed tube 1*c* was subjected to liquid honing by using a commercially available liquid honing machine "LH-5T" (Trademark), made by Fuji Seiki Machine Works, Ltd. The electroseamed tube 1*c* was blasted with a mixture of water and an abrasive material, that is, 320-grit alundum and 400-grit glass beads at a pressure of 4 kg·f/cm$^2$ for 20 sec.

One end portion of the above-prepared electroseamed tube 1*c* was curled, as shown in FIG. 5($b_1$).

Under the same conditions as in Example 1, the electroseamed tube 1c was subjected to the one-step ironing process at the ironing efficiency of 37.5%.

Thus, a base drum of an electrophotographic photoconductor according to the present invention was obtained.

The surface roughness (Rmax) and the dimensional accuracy of the obtained base drum are shown in Table 6.

EXAMPLE 9

An Al-Mg alloy (5052H-24) in the form of a drum was continuously welded by a high-frequency welder 6 via a plurality of rollers 5, as shown in FIG. 3. The welded portion was machined by a cutting tool 7 and cut by a cutter 8, so that an Al-Mg alloy electroseamed tube 1b was prepared.

The thus prepared electroseamed tube 1b was subjected to plug-inserted drawing as shown in FIG. 4, so that the drawn electroseamed tube 1c having an outer diameter of 41.2 mm, a thickness of 1.6 mm and a length of 203 mm was obtained.

The thus prepared electroseamed tube 1c was subjected to liquid honing by using a commercially available liquid honing machine "LH-5T" (Trademark), made by Fuji Seiki Machine Works, Ltd. The electroseamed tube 1c was blasted with a mixture of water and an abrasive material, that is, 320-grit alundum at a pressure of 2 kg·f/cm$^2$ for 40 sec.

One end portion of the above-prepared electroseamed tube 1c was curled, as shown in FIG. 5($b_1$).

Under the same conditions as in Example 1, the electroseamed tube 1c was subjected to the one-step ironing process at the ironing efficiency of 37.5%.

Thus, a base drum of an electrophotographic photoconductor according to the present invention was obtained.

The surface roughness (Rmax) and the dimensional accuracy of the obtained base drum are shown in Table 6.

EXAMPLE 10

An Al-Mg alloy (5052H-24) in the form of a drum was continuously welded by a high-frequency welder 6 via a plurality of rollers 5, as shown in FIG. 3. The welded portion was machined by a cutting tool 7 and cut by a cutter 8, so that an Al-Mg alloy electroseamed tube 1b was prepared.

The thus prepared electroseamed tube 1b was subjected to plug-inserted drawing as shown in FIG. 4, so that the drawn electroseamed tube 1c having an outer diameter of 41.2 mm, a thickness of 1.6 mm and a length of 203 mm was obtained.

The thus prepared electroseamed tube 1c was subjected to liquid honing by using a commercially available liquid honing machine "LH-5T" (Trademark), made by Fuji Seiki Machine Works, Ltd. The electroseamed tube 1c was blasted with a mixture of water and an abrasive material, that is, 1000-grit alundum at a pressure of 4 kg·f/cm$^2$ for 40 sec.

One end portion of the above-prepared electroseamed tube 1c was curled, as shown in FIG. 5($b_1$).

Under the same conditions as in Example 1, the electroseamed tube 1c was subjected to the one-step ironing process at the ironing efficiency of 37.5%.

Thus, a base drum of an electrophotographic photoconductor according to the present invention was obtained.

The surface roughness (Rmax) and the dimensional accuracy of the obtained base drum are shown in Table 6.

TABLE 6

| Example No. | 8 | 9 | 10 |
|---|---|---|---|
| Drawn Electroseamed Tube | | | |
| Surface roughness (Rmax) | 3.44 μm | 2.96 μm | 3.28 μm |
| Surface condition | drawn surface | drawn surface | drawn surface |
| Wall-thickness non-uniformity (mm) | 0.011 (max) | 0.018 (max) | 0.006 (max) |
| After Liquid Honing | | | |
| Surface roughness (Rmax) | 7.82 μm | 4.24 μm | 3.96 μm |
| Surface condition | rough satin | satin | satin |
| Wall-thickness non-uniformity (mm) | 0.018 (max) | 0.023 (max) | 0.012 (max) |
| After Ironing | | | |
| Surface roughness (Rmax) | 2.90 μm | 1.40 μm | 0.98 μm |
| Surface condition | ironed satin surface | ironed matte surface | ironed matte surface |
| Wall-thickness non-uniformity (mm) | 0.006 (max) | 0.006 (max) | 0.006 (max) |
| Straightness (mm) | 0.015 (max) | 0.015 (max) | 0.018 (max) |
| Roundness (mm) | 0.008 (max) | 0.005 (max) | 0.008 (max) |

As previously explained, the method for preparation of a base drum of an electrophotographic photoconductor according to the present invention has the following advantages:

(1) Since an electroseamed tube is subjected to a suitable ironing process, or sinking-ironing process in the present invention, a thin-walled base drum with a long length and a small diameter or a large diameter can be prepared with high dimensional accuracy at low cost without machining process.

In addition, when the electroseamed tube is subjected to grinding or abrasion finishing prior to the ironing or sinking-ironing process, the base drum with uniform surface roughness can be obtained.

(2) When the electroseamed tube is subjected to honing, electropolishing or anodizing prior to the ironing or sinking-ironing process, the base drum having a desired surface profile such as mirror surface, matte surface or satin surface, and the desired surface roughness can be obtained.

(3) A metallic strip, one of the material for the electroseamed tube for use in the present invention, is cold-worked by a pressure roll, so that it is superior in the wall-thickness non-uniformity. For instance, the wall-thickness non-uniformity of electroseamed tubes with a diameter of 40 to 60 mm and a thickness of 2.0 mm or less is as small as ±0.02 mm or less not only on the same circumference, but also in the lengthwise direction of the tube.

(4) The aforementioned electroseamed tube which is superior in the wall-thickness non-uniformity is suitable for the ironing process. The tube is uniformly ironed in the circumferential direction and in the lengthwise direction by the ironing process, so that the properly ironed electroseamed tube can be obtained. In addition, the wall-thickness non-uniformity can be further reduced and the dimensional accuracy can be further improved when the ironing conditions are appropriate for the employed electroseamed tube.

(5) When the electroseamed tube which is superior in the wall-thickness non-uniformity is subjected to the surface treatment such as grinding or abrasion finishing, and then to the ironing process, a variety of surface profiles and a desired surface roughness can be obtained in accordance with difference in the surface profile by the above-mentioned surface treatment.

In this procedure, when the ironing conditions or the sinking-ironing conditions are proper, satisfactory surface profile and high dimensional accuracy of the base drum can be obtained at the same time.

(6) An electroseamed tube can easily be formed regardless of the tube diameter, and a long-length electroseamed tube can be mass-produced at low cost. Therefore, the electroseamed tube is advantageous to the preparation of a base drum of the electrophotographic photoconductor.

More specifically, when a tube prepared by impact extrusion is subjected to the ironing process or the sinking-ironing process many steps are necessitated to make the wall-thickness of the tube uniform. In contrast to this, when the tube is prepared by the electroseaming method, a thin-walled tube of long length can be obtained, with the wall-thickness non-uniformity minimized, so that the base drum of the photoconductor with high dimensional accuracy can be prepared through a minimum number of steps.

What is claimed is:

1. A method for producing a base drum for an electrophotographic photoconductor, comprising the sequential steps of:

forming a metallic sheet in the form of a tube having a seam;

welding said seam of said tube by high-frequency welding to form an electroseamed tube;

curling one end of said electroseamed tube in an inner direction thereof, thereby forming a curled end portion at one end of said electroseamed tube, and an open end portion of said electroseamed tube;

inserting a plug into said electroseamed tube from said open end thereof up to said curled end portion thereof to be fixed at said curled end portion;

setting said curled end portion of said electroseamed tube at a slot of a die, wherein said slot has a diameter smaller than an outer diameter of said electroseamed tube;

pushing said plug in such a direction as to cause said electroseamed tube to pass through said slot of said die, thereby ironing said electroseamed tube; and cutting both end portions of said electroseamed tube.

2. The method as claimed in claim 1, further comprising the steps of plug-inserted drawing said electroseamed tube, and improving the straightness of said tube by use of correcting rollers subsequent to said welding step.

3. The method as claimed in claim 2, further comprising a step of sinking said electroseamed tube into an accurate cylindrical form subsequent to said curling step.

4. The method as claimed in claim 3, further comprising a step of treating the surface of said electroseamed tube, by grinding or abrasion finishing subsequent to said curling step and prior to said sinking step.

5. The method as claimed in claim 3, further comprising a step of treating the surface of said electroseamed tube, by grinding or abrasion finishing subsequent to said plug-inserted drawing and correcting steps and prior to said curling step.

6. The method as claimed in claim 3, further comprising a step of treating the surface of said electroseamed tube, by honing, electropolishing or anodizing subsequent to said curling step and prior to said sinking step.

7. The method as claimed in claim 3, further comprising a step of treating the surface of said electroseamed tube, by honing, electropolishing or anodizing subsequent to said plug-inserted drawing and correcting steps and prior to said curling step.

8. The method as claimed in claim 2, further comprising a step of treating the surface of said electroseamed tube, by grinding or abrasion finishing subsequent to said curling step and prior to said ironing step.

9. The method as claimed in claim 2, further comprising a step of treating the surface of said electroseamed tube, by grinding or abrasion finishing subsequent to said plug-inserted drawing and correcting steps and prior to said curling step.

10. The method as claimed in claim 2, further comprising a step of treating the surface of said electroseamed tube, by honing, electropolishing or anodizing subsequent to said curling step and prior to said ironing step.

11. The method as claimed in claim 2, further comprising a step of treating the surface of said electroseamed tube, by honing, electropolishing or anodizing subsequent to said plug-inserted drawing and correcting steps and prior to said curling step.

12. The method as claimed in claim 1, further comprising steps of cutting said electroseamed tube to a predetermined length subsequent to said welding step and prior to said curling step, and sinking said electroseamed tube into an accurate cylindrical form subsequent to said curling step.

13. The method as claimed in claim 12, further comprising a step of treating the surface of said electroseamed tube, by grinding or abrasion finishing subsequent to said curling step and prior to said sinking step.

14. The method as claimed in claim 12, further comprising a step of treating the surface of said electroseamed tube, by grinding or abrasion finishing subsequent to said welding step and prior to said curling step.

15. The method as claimed in claim 12, further comprising a step of treating the surface of said electroseamed tube, by honing, electropolishing or anodizing subsequent to said curling step and prior to said sinking step.

16. The method as claimed in claim 1, further comprising a step of treating the surface of said electroseamed tube, by grinding or abrasion finishing subsequent to said curling step and prior to said ironing step.

17. The method as claimed in claim 1, further comprising a step of treating the surface of said electroseamed tube, by grinding or abrasion finishing subsequent to said welding step and prior to said curling step.

18. The method as claimed in claim 1, further comprising a step of treating the surface of said electroseamed tube, by honing, electropolishing or anodizing subsequent to said curling step and prior to said ironing step.

19. The method as claimed in claim 1, further comprising a step of treating the surface of said electroseamed tube, by honing electropolishing or anodizing subsequent to said welding step and prior to said curling step.

20. The method as claimed in claim 12, further comprising the step of treating the surface of said electroseamed tube, by honing, electropolishing or anodizing subsequent to said welding step and prior to said curling step.

* * * * *

UNITED STATES PATENT AND TRADEMARK OFFICE

CERTIFICATE OF CORRECTION

PATENT NO. : 5,321,889

DATED : June 21, 1994

INVENTOR(S) : Tadashi Watanabe

It is certified that error appears in the above-identified patent and that said Letters Patent is hereby corrected as shown below:

Column 5, line 27, "further preferable" should read --further preferably--.

Column 8, line 59, "method ma be" should read --method may be--.

Column 10, lines 9-24, delete in their entirety.

Column 14, lines 29-35, delete in their entirety.

Column 16, after Table 6, insert --In the above measurement, the measuring apparatus were the same as those in Table 5.--.

Signed and Sealed this

Nineteenth Day of September, 1995

*Attest:*

*Attesting Officer*

Bruce Lehman

BRUCE LEHMAN

*Commissioner of Patents and Trademarks*